US007367814B2

(12) United States Patent
Liao

(10) Patent No.: US 7,367,814 B2
(45) Date of Patent: May 6, 2008

(54) ELECTRICAL CONTACTS USED IN AN ELECTRICAL CONNECTOR

(75) Inventor: Chi-Nan Liao, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/656,081

(22) Filed: Jan. 22, 2007

(65) Prior Publication Data

US 2007/0173137 A1 Jul. 26, 2007

(30) Foreign Application Priority Data

Jan. 20, 2006 (TW) ..... 95102305 A

(51) Int. Cl.
*H01R 12/00* (2006.01)

(52) U.S. Cl. ..... 439/71

(58) Field of Classification Search ..... 439/71, 439/83, 862

See application file for complete search history.

(56) References Cited

U.S. PATENT DOCUMENTS

| | | | | |
|---|---|---|---|---|
| 6,905,377 | B2 * | 6/2005 | Murr | 439/862 |
| 6,955,572 | B1 * | 10/2005 | Howell | 439/826 |
| 6,976,888 | B2 * | 12/2005 | Shirai et al. | 439/862 |
| 2004/0077190 | A1 * | 4/2004 | Huang et al. | 439/66 |
| 2005/0054218 | A1 * | 3/2005 | Liao et al. | 439/66 |

* cited by examiner

*Primary Examiner*—Phuong Dinh
(74) *Attorney, Agent, or Firm*—Wei Te Chung

(57) ABSTRACT

An electrical contact for electrically connecting an IC package and a circuit board includes a base portion, a resilient portion which includes a medial portion extending from the base portion and a connecting portion, a mating portion extending from the upper end of the connecting portion and having a mating point in the free end thereof, a tail portion extending from a lower end of the base portion. The connecting portion extends substantially parallel to the medial portion and distant to the medial portion, thus a distance in a horizontal direction between the medial portion and the resilient portion is formed and the elastic property of the electrical contact increases.

1 Claim, 5 Drawing Sheets

ELECTRICAL CONTACTS USED IN AN ELECTRICAL CONNECTOR

BACKGROUND OF THE INVENTION

1. Field of the Invention

Embodiments of the present invention relate generally to electrical contacts and, more particularly, to electrical contacts used in electrical connectors for connecting circuit boards with integrated circuit (IC) packages.

2. Background of the Invention

Land grid array (LGA) electrical connectors are widely used in the electronic field for connecting an IC package with a circuit board and this technology is disclosed in the "Nonlinear Analysis Helps Design LGA Connectors" (Connector Specifier, February). The conventional LGA connector includes a housing defining a number of passageways arranged in a matrix, and a corresponding number of electrical contacts received in the passageways. Each of the contacts has an upper contact portion and a lower solder portion. The upper contact portion mates with the contact pad of the IC package and the lower solder portion is soldered to the contact pad of the circuit board for making an electrical connection between the IC package and the circuit board.

Following the developed of the electronic technology, the arraying density of the contact pads of the IC package and the circuit board gets larger and larger while the size and height of the contact gets smaller and smaller. In this case, the rigidity of the contact increases while the elastic property of the contact reduces due to the size and the height of the contact gets smaller, which causes the electrically connection between the IC package and the contact to be poor. Hence, it must increase the elastic property of the contact so that a good connection between the IC package and the electrical contact is ensured.

In view of the above, a new electrical contact which enables to overcome the above-mentioned disadvantages is desired.

SUMMARY

Therefore, a need exists for an electrical contact which has a good elastic property when mating with an IC package.

According to a preferred embodiment of the invention, An electrical contact for electrically connecting an IC package with a circuit board comprises a base portion, a resilient portion which includes a medial portion extending from the base portion and a connecting portion, a mating portion extending from the upper end of the connecting portion and having a mating point in the free end thereof; a tail portion extending from a lower end of the base portion, the connecting portion extends substantially parallel to the medial portion and separated by a specified distance from the medial portion in a horizontal direction;

The present invention has several advantages as below: the electrical contact attains an improvement in elastic and mechanical property by defining a resilient portion which is separated by a specified distance in a horizontal direction from the medial portion.

The present invention will be well understood when read in junction with the following drawing, in which:

DETAILED DESCRIPTION OF THE PREFERRED EMBODIMENT OF THE INVENTION

The invention will now be described in greater detail with reference to the figures.

Figure 1:
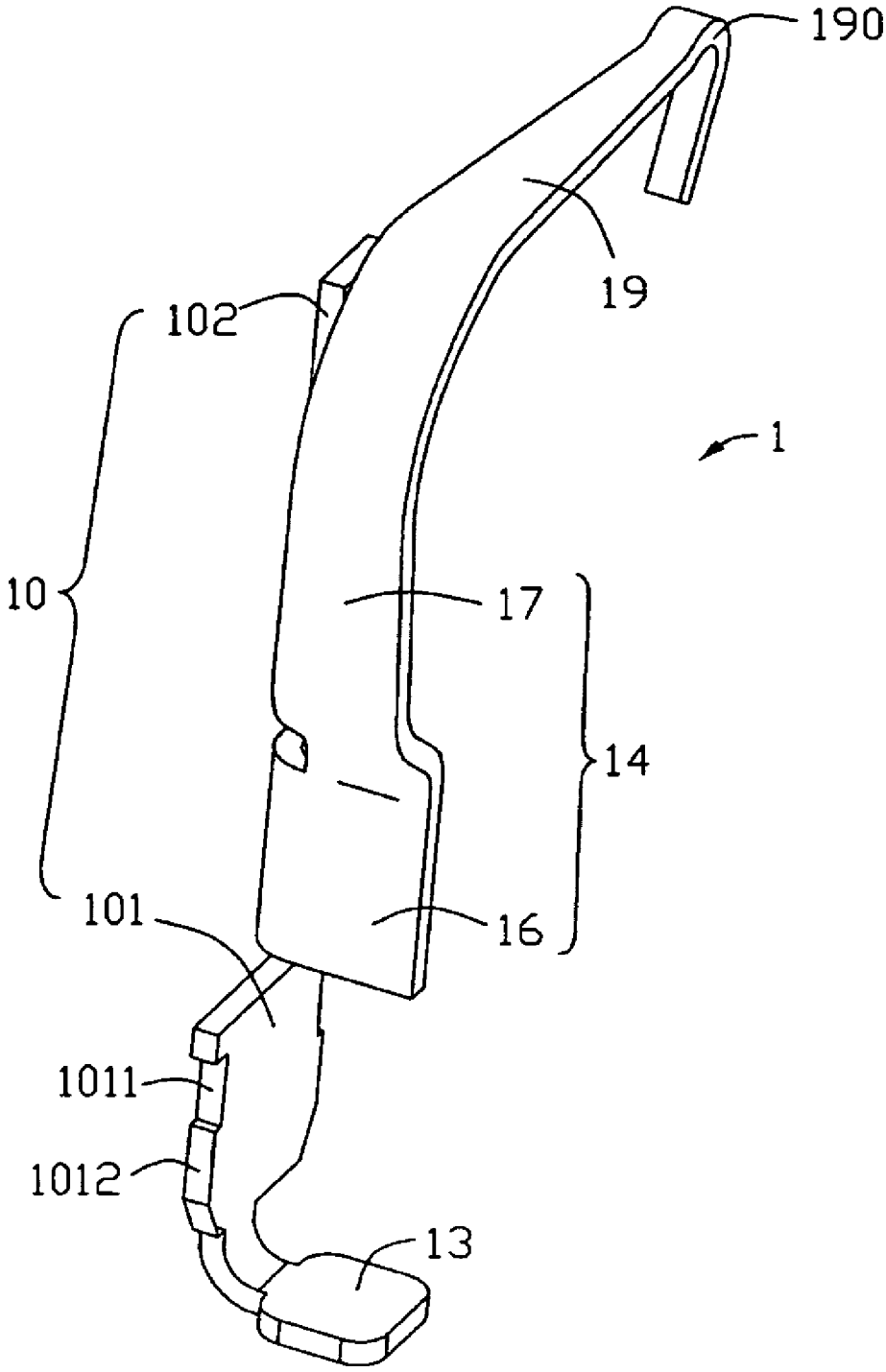
FIG. 1 is a perspective view of an electrical contact in accordance with a first embodiment of the present invention.
Figure 2:
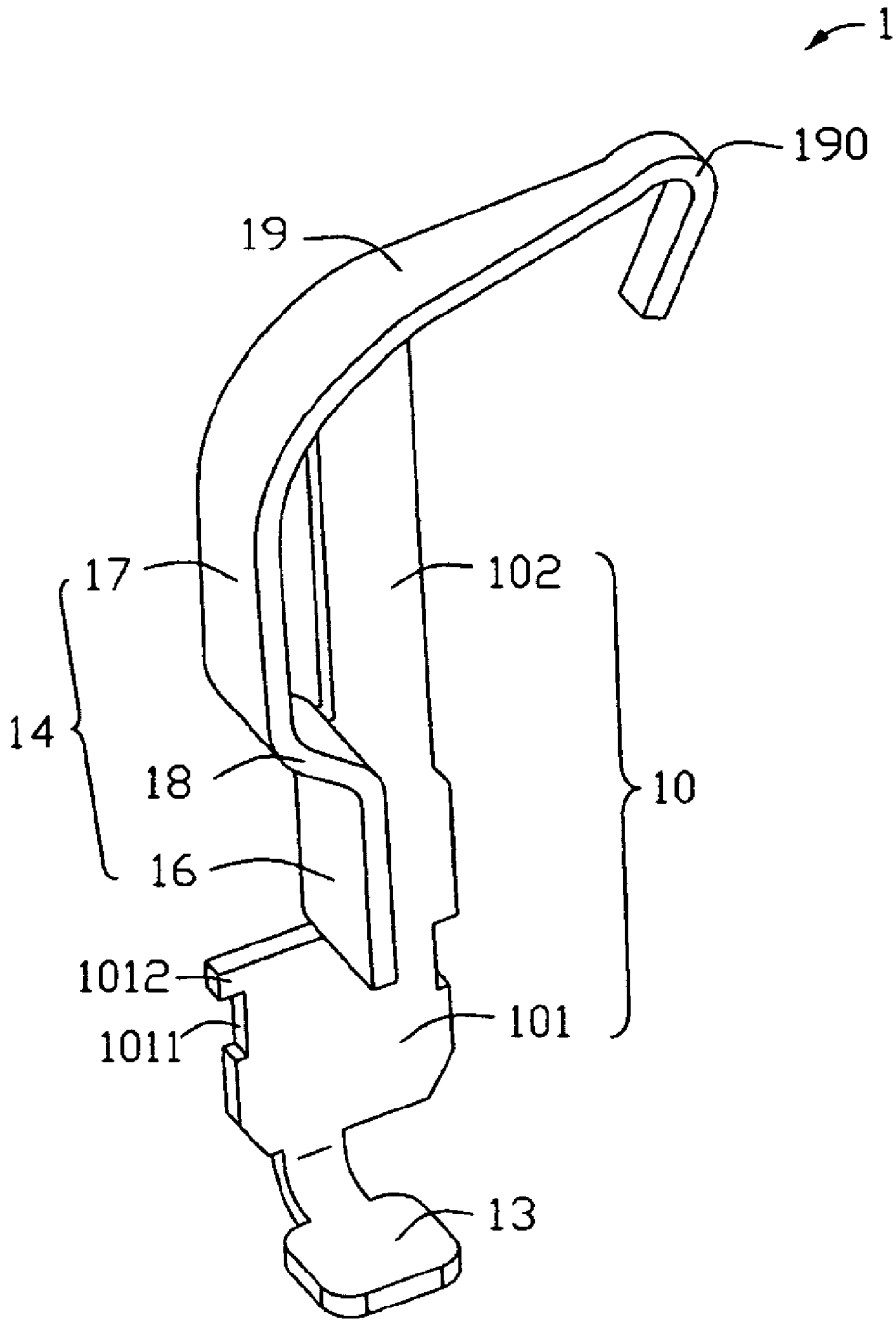
FIG. 2 is another perspective view of an electrical contact of FIG. 1.

Referring to FIGS. 1-2, an electrical contact 1 for attaching an IC package (not shown) to a circuit board (not shown) comprises a base portion 10, a resilient portion 14 extending from the base portion 10, a mating portion 19 extending from the upper end of the resilient portion 14, and a tail portion 13 extending from a lower end of the base portion 10. The base portion 10 has a flat structure and includes a body portion 101 and a main portion 102 extending upward from the body portion 101, and the width of the main portion 102 is smaller than that of the body portion 101. A plurality of anchoring projections 1012 is formed on each of two opposite side walls 1011 of the body portion 101 for retaining the electrical contact 1 on the electrical connector (not shown). The tail portion 13 is disposed on a lower end of the body portion 101 and extends in a direction perpendicular to the body portion 101.

The resilient portion 14 adjacent to the main portin 102 includes a medial portion 16 extending from one side of the main portion 102 and a connecting portion 17. The connecting portion 17 extends substantially parallel to the medial portion 16 and distant to the medial portion 16 in a horizontal direction. The medial portion 16 is obtuse to the main portion 17, such as the angle between the main portion 17 and the media portion 16 is approximately 145 degrees. The medial portion 16 locates on the same side 1011 of the body portion 101 as the tail portion 13. The medial portion 16 and the connecting portion 17 both have a linear configuration. The upper end of the connecting portion 17 is lower than the upper end of the main portion 102. A bridge portion 18 being curved configuration interconnects the medial portion 16 and the connecting portion 17 and separates the connecting portion 17 by a specified distance from the medial portion 16 in a horizontal direction, thus the whole length of the resilient portion 14 increases and the elastic property of the electrical contact 1 increases correspondingly. A mating portion 19 extends upward from an upper end of the connecting portion 17 and the width of the mating portion 19 gradually decreases extending upward from the upper end of the connecting portion 17. The free end of the mating portion 19 defines a mating point 190 which has a rolled surface so that contact stability between the electrical contact and the IC package is ensured.

The electrical connector is mounted on the circuit board by connecting solder balls (not shown) disposed on the under surface of the tail portion 13 to contact pads on a circuit board by soldering. When the IC package is mounted on the electrical connector from above, the contact pads disposed on the IC package contact the mating point 190 of the respective electrical contacts 1 and push the mating portion 19 downward, then the resilient portion 14 and the bridge portion 18 undergoes elastic deformation so that the mating point 190 slides in a horizontal direction relative to the IC package until the mating portion 190 has a good connection with the IC package. Because the bridge portion 18 is defined between the connecting portion 17 and the medial portion 16, the connecting portion 17 is separated by a specified distance from the medial portion 16 in a horizontal direction, so that the elastic property of the electrical contact 1 increases and the contact stability of between the electrical contact 1 and the IC package is ensured.

Figure 3:
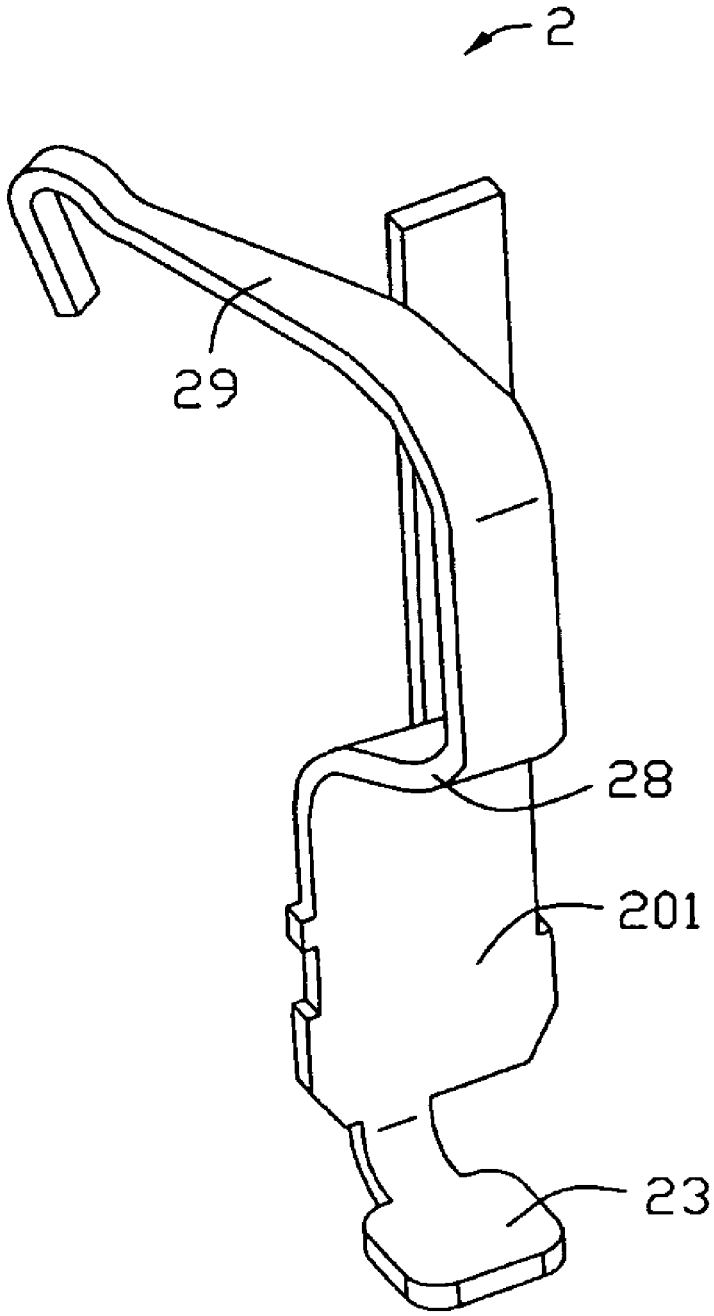
FIG. 3 is a perspective view of an electrical contact in accordance with a second embodiment of the present invention.

Referring to FIG. 3, an electrical contact 2 according to the second embodiment of the present invention is shown. It is only need to describe some differences between the first embodiment and the second embodiment thereinafter. In this embodiment, a bridge portion 28 extends from one end of the body portion 201 directly toward a tail portion 23 instead of defining a medial portion. The other structures such as the mating portion 29 are the same as that in the first embodiment and are not need to described.

Figure 4:
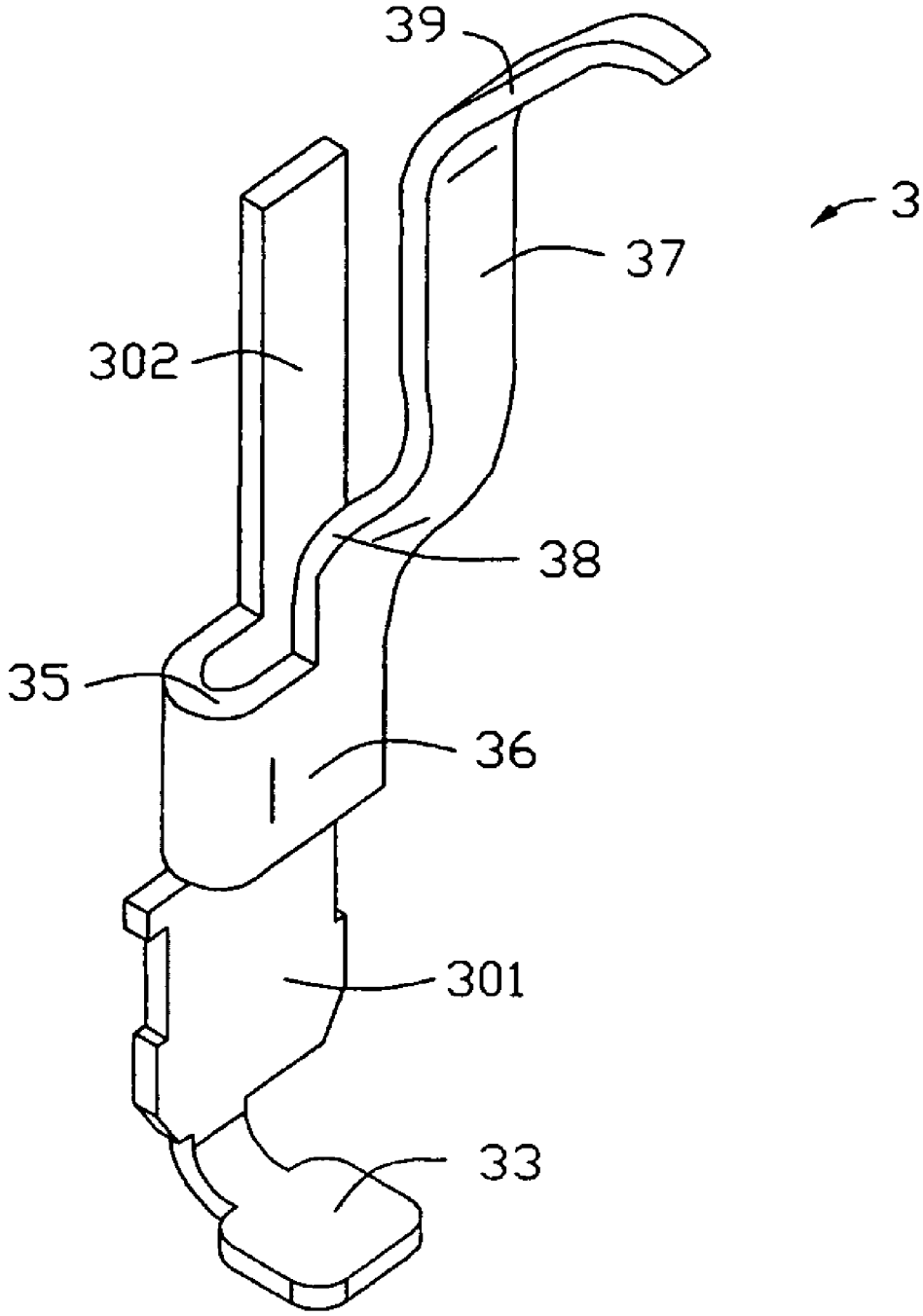
FIG. 4 is a perspective view of an electrical contact in accordance with a third embodiment of the present invention.

Referring to FIG. 4, an electrical contact 3 according to the third embodiment of the present invention is shown. It is only need to describe some differences between the third embodiment and the first embodiment thereinafter. In the third embodiment, an upper end of the main portion 302 is lower than the end of connecting portion 37 connecting with the mating portion 39. The medial portion 36 extends parallel to the main portion 302 and attached to one of side walls of the body portion 302 by a curved portion 35 angled approximately 180 degrees from the one side wall. The other structures such as the body portion 301, the connecting portion 37, the bridge portion 38 and the mating portion 390 are the same as that in the first embodiment and are not need to described.

Figure 5:
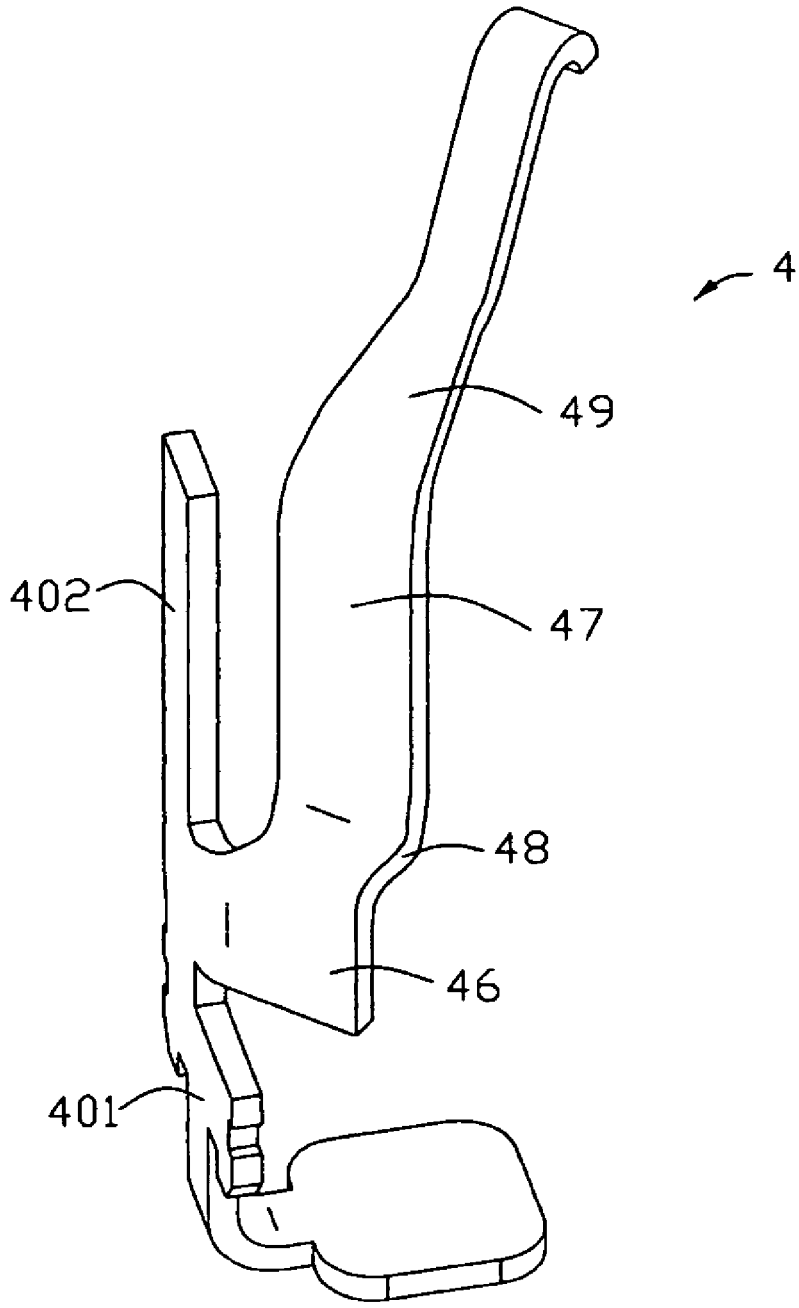
FIG. 5 is a perspective view of an electrical contact in accordance with a forth embodiment of the present invention.

Referring to FIG. 5, an electrical contact 4 according to the forth embodiment of the present invention is shown. It is only need to describe some differences between the forth embodiment and the first embodiment thereinafter. In the forth embodiment, the free end of the main portion 402 is lower than the end of connecting portion 47 connecting with the curved portion 49. The other structures such as the body portion 401, the bridge portion 48 and the mating portion 49 are the same as that in the second embodiment and are not described.

The connecting portion 27, 37, 47 of the electrical contact 2, 3, 4 has a linear configuration and a distance in a horizontal direction is formed between the connecting portion 27, 37, 47 and the medial portion 26, 36, 46 respectively, thus the elastic property of the contact 2, 3, 4 increases and the contact stability between the electrical contact and the IC package is ensured.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical contact comprising: a base portion; a medial portion extending parallel to the base portion and attached to one of the side walls of the base portion by a curved portion angled approximately 180 degrees from the one side wall; an angle bridge portion extending from the medial portion; a connecting portion attached to the bridge portion and extending substantially parallel to the medial portion and distant to the medial portion; a mating portion extending from an upper end of the connecting portion and having a mating point in a free end thereof; a tail portion extending from a lower end of the base portion wherein the base portion includes a body portion and a main portion extending upward from the body portion, the medial portion extending from the main portion.

* * * * *